US006588639B2

(12) United States Patent
Beletsky et al.

(10) Patent No.: US 6,588,639 B2
(45) Date of Patent: Jul. 8, 2003

(54) MOLDED HOLSTER BELT LOOP ASSEMBLY WITH SHELF

(75) Inventors: Robert J. Beletsky, Fallbrook, CA (US); Carl R. Eerdmans, Fallbrook, CA (US); Anthony G. Lefeber, Temecula, CA (US)

(73) Assignee: Bianchi International, Temecula, CA (US)

( * ) Notice: Subject to any disclaimer, the term of this patent is extended or adjusted under 35 U.S.C. 154(b) by 3 days.

(21) Appl. No.: 10/006,598

(22) Filed: Dec. 3, 2001

(65) Prior Publication Data

US 2002/0070253 A1 Jun. 13, 2002

Related U.S. Application Data

(60) Provisional application No. 60/254,706, filed on Dec. 11, 2000.

(51) Int. Cl.[7] ..... F41C 33/02

(52) U.S. Cl. ..... 224/672; 224/192; 224/674; 224/911

(58) Field of Search ..... 224/192, 665, 224/672, 674, 911, 912, 198

(56) References Cited

U.S. PATENT DOCUMENTS

| | | | | | |
|---|---|---|---|---|---|
| 3,610,487 | A | * | 10/1971 | Campos | 224/198 |
| 4,905,880 | A | * | 3/1990 | Cupp | 224/192 |
| 4,971,236 | A | * | 11/1990 | Grummet | 224/243 |
| 5,421,497 | A | * | 6/1995 | Gilmore | 224/198 |
| 5,477,997 | A | * | 12/1995 | Weatherly | 224/44.5 |
| 5,551,611 | A | * | 9/1996 | Gilmore | 224/198 |
| 5,598,958 | A | * | 2/1997 | Ryan et al. | 224/198 |
| 6,010,045 | A | * | 1/2000 | Rogers et al. | 224/198 |
| 6,161,741 | A | * | 12/2000 | French | 224/198 |

* cited by examiner

*Primary Examiner*—Stephen P. Garbe
(74) *Attorney, Agent, or Firm*—John E. Wagner

(57) ABSTRACT

An improved belt-loop assembly for hanging goods from a belt primarily used in conjunction with a holster. The belt loop assembly has a tapered belt loop opening and a platform upon which the belt rests. The taper aids in fixedly positioning the assembly along the belt while the platform protects the belt from wear due to belt positioning screws commonly found in belt loop assemblies.

17 Claims, 6 Drawing Sheets

MOLDED HOLSTER BELT LOOP ASSEMBLY WITH SHELF

REFERENCE TO RELATED APPLICATION

This non-provisional patent application claims benefit of U.S. provisional patent application serial No. 60/254,706 filed Dec. 11, 2000, and hereby claims the benefit of the embodiments therein and of the filing date thereof.

BACKGROUND OF THE INVENTION

Holsters for side arm weapons are frequently worn by both military and law enforcement personnel and are traditionally suspended from the duty belt of the wearer. The most common method of suspending a holster from a belt is to incorporate a holster belt loop assembly as a permanent part of the holster. The wearer's belt is then passed through the belt loop assembly, thus allowing the holster to hang from the belt.

It is of utmost importance for the holster wearer to be able to precisely and fixedly position the holster along the belt. Such precise placement allows the wearer to position the holster in the best possible location for a smooth and rapid removal of the weapon should circumstances require.

Heretofore, a holster with a holster belt loop assembly was locked into position along the belt either by friction between the belt and the belt loop or by tightening a screw or screws at the base of the belt loop assembly. The screws, which passed through the belt loop assembly, were secured by a nut; and upon tightening the screws, the sides of the belt loop assembly were compressed against the belt. This compressive force holds the holster in position along the belt. Unfortunately, positioning the holster in this manner can result in damage to the belt, since the threads of the screws often come into direct contact with the belt. Damage to the duty belt is unacceptable. Over time, damage to the belt caused by the screws could result in the failure of the holster to stay fixed along the wearer's belt and any movement in the position of the holster may inhibit the wearer's ability remove the weapon from the holster.

BRIEF SUMMARY OF THE INVENTION

Upon examination of the foregoing state of the prior art holster, we have invented a molded belt loop assembly, which includes an internal shelf and tapered belt loop configuration which eliminates the foregoing problems. As with prior art holsters, the inventive belt loop assembly is made a permanent part of the holster. The inventive belt loop assembly allows the wearer to position and fix the belt loop assembly along the duty belt with greater precision while reducing the likelihood of damaging the belt.

In the inventive belt loop assembly, the duty belt passes through the belt loop opening and rests upon a ridge or shelf, which extends upward from the base of the belt loop opening. The holster is secured into position along the belt by one or more, but preferably, a pair of belt loop tightening screws which, when tightened, exert a force upon two integral belt loop fingers, which are forced inward against the belt. These belt loop fingers exert a compressive force upon the belt and thus secure the holster to the belt at the desired position. The aforementioned ridge or shelf provides a stable platform upon which the belt can rest and keeps the belt above the belt loop screws, to help prevent their contact with the belt.

To aid in fixing the position of the holster along the belt, the belt loop opening is tapered inwardly against the belt at two locations. First, the belt loop opening is tapered from its outside edges towards its center. The belt loop opening also includes a taper on one side of the upper interior portion of the opening. Both tapers act to wedge the belt into the belt loop opening. Together, the tapers of the belt loop opening and the belt loop fingers securely fix the holster along the belt while reducing the danger of damaging the belt from contact with the belt loop screws.

These and other features provide an improved molded belt loop holster.

BRIEF DESCRIPTION OF THE DRAWINGS

This invention may be more clearly understood with the following description and by reference to the drawings in which:

FIG. 1 is comprised of FIGS. 1*a* and 1*b*, in which

DETAILED DESCRIPTION

Figure 1A:
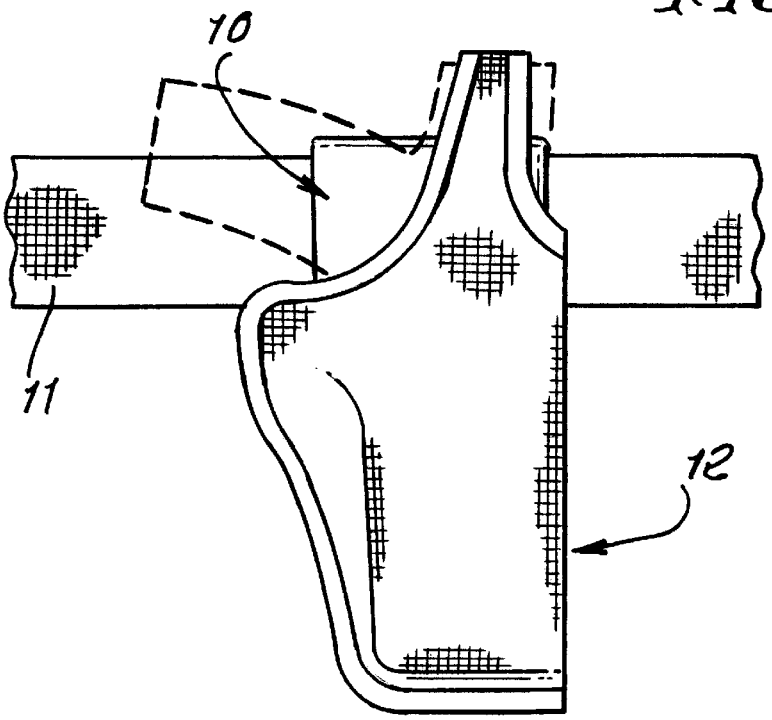
FIG. 1*a* is a side elevational view of a typical belt worn holster employing the belt loop of this invention and a handgun shown in phantom.
Figure 1B:
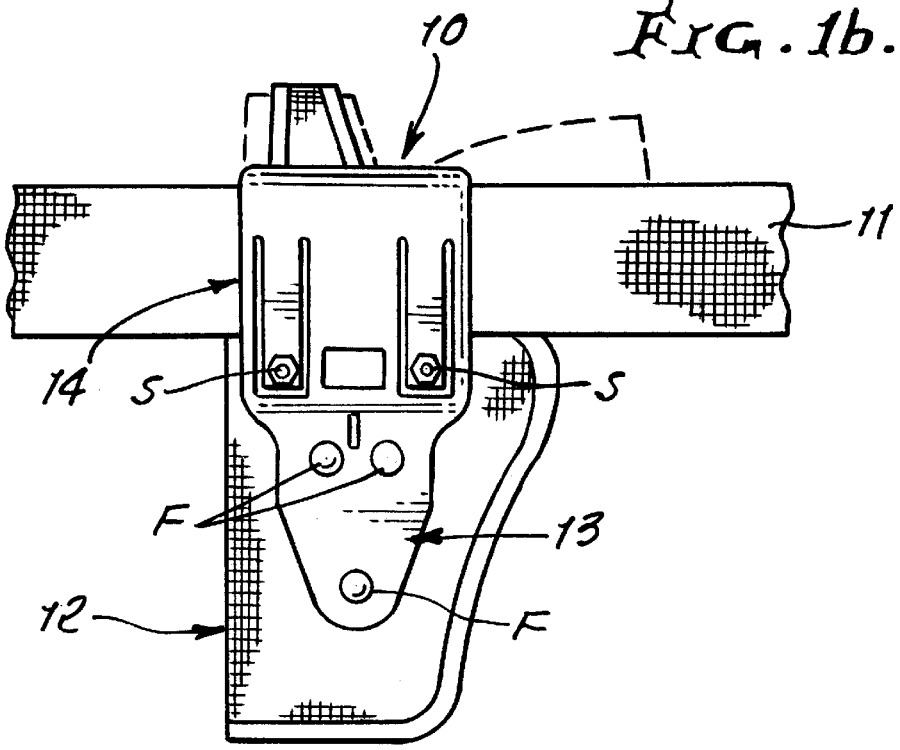
FIG. 1*b* is a rear side elevational view of the holster of FIG. 1*a;*

Now referring to the drawings, FIG. 1*a* illustrates a typical duty holster 12 with weapon (shown in phantom) incorporating the belt loop assembly 10 of this invention supported on a belt 11. FIG. 1*b*, which is a rear side elevational view of FIG. 1*a*, best illustrates the belt loop assembly 10, which includes belt clamp assembly 14 and offset holster attachment 13. The holster 12 is attached to the belt loop assembly 10 at the offset attachment 13 by three fasteners F, such as rivets, screws, or possibly sonic, or plastic welds or other securing means.

Figure 2:
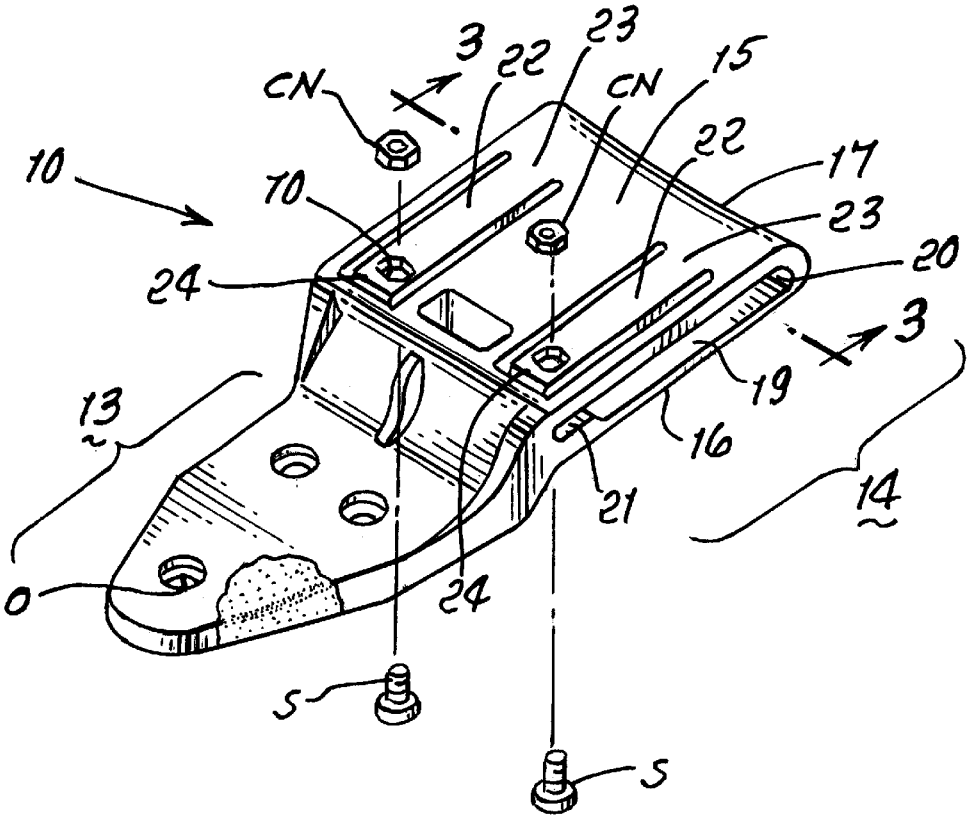
FIG. 2 is a rear aspect perspective view of the inventive belt loop assembly.

In the step of installing the holster 12 on belt 11, the wearer's belt 11 moves freely through the clamp assembly 14 until fixed into position by way of two screws S at the base of the clamp assembly 14, which engage capture nuts CN, not shown in FIG. 1*b*, but best shown in FIG. 2.

FIG. 2 illustrates belt loop assembly 10 as a unitary body including clamp assembly 14. Assembly 14 has a rear face 15, which rests against the wearer's body, and a front face 16. Rear face 15 and front face 16 are both slightly curved, to conform with the curvature of the wearers body with the curvature best shown in FIG. 3. Rear face 15 and front face 16 are separated by belt loop opening 19, which is generally oval and elongated in shape and is designed to receive a belt. In the preferred embodiment, belt loop assembly 10 is partially rounded at its top 17 so as to eliminate any sharp edges.

Figure 5:
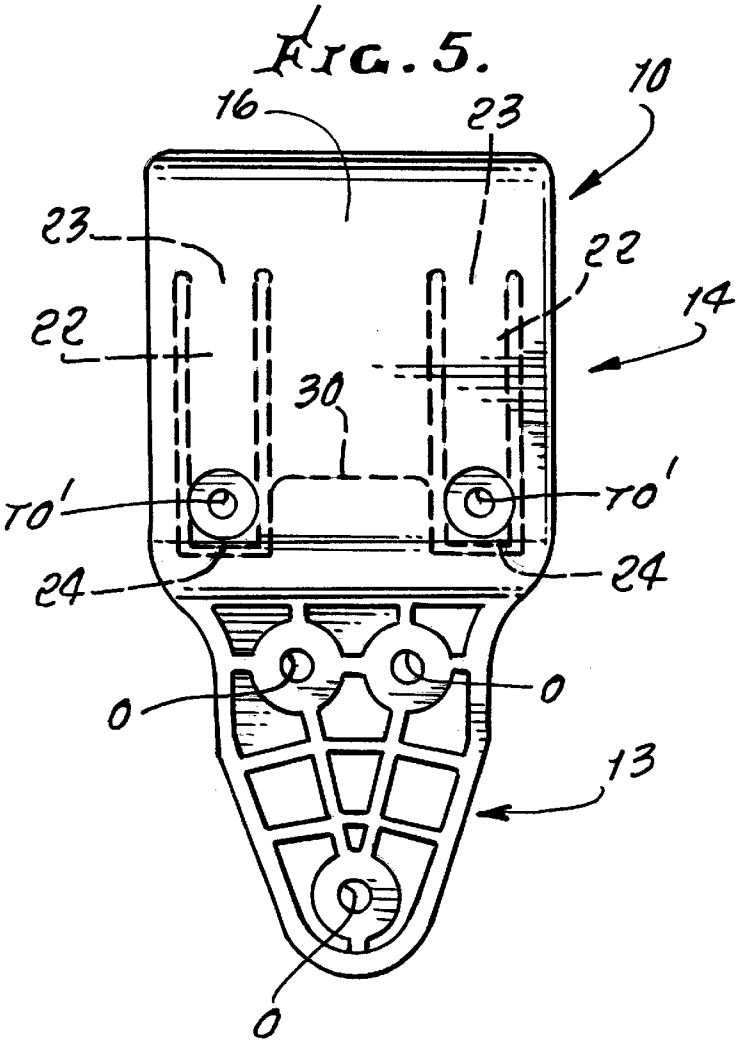
FIG. 5 is a front side elevational view of the inventive belt loop showing the clamping tongues or fingers and belt ridge or shelf in phantom.

Belt loop assembly 10 also includes an offset attachment 13 which, in the preferred embodiment, is attached to holster 12 by fasteners, not shown in FIG. 2, which engage holster 12 through three openings O best shown in FIG. 5.

Belt loop assembly 10 may be made from a variety of materials; however, in the preferred embodiment, the material of construction is a lightweight, yet strong, plastic, such as molded nylon.

The rear face 15 of the clamp assembly 14 includes one or two generally rectangular-shaped integral tongues or fingers 22. Each finger 22 has a proximal end 23 and a distal end 24. The proximal end 23 is formed as part of rear face 15, whereas each distal end 24 is disconnected from rear face 15 so as to allow finger 22 to flex about its proximal end 23. In the preferred embodiment, each tongue's distal end 24 has a recess R as well as an opening TO best shown in FIG. 8. The recess R is designed to receive a capture nut CN or other securing means. Opening TO in distal end 24 of tongue 22 corresponds with opening TO' in front face 16 of clamp assembly 14, best seen in FIG. 5, and is designed to receive screws or other securing means.

Figure 4:
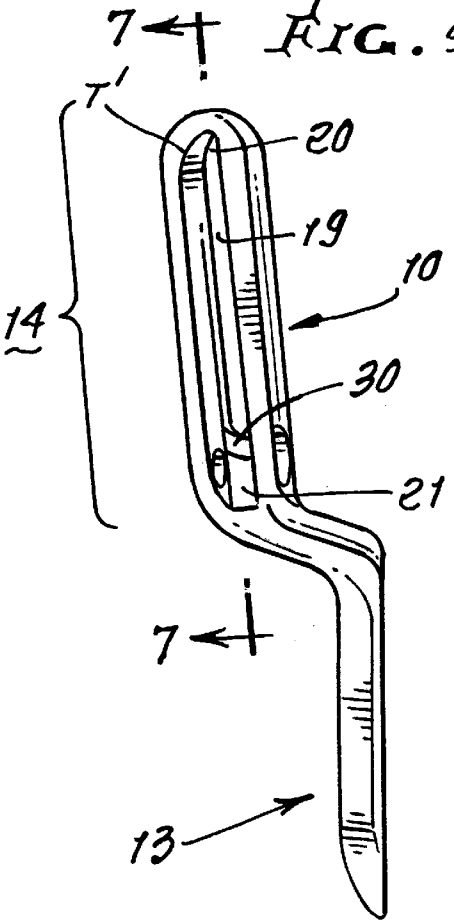
FIG. 4 is a side elevational view of the inventive belt loop showing the belt ridge or shelf and second taper.
Figure 8:
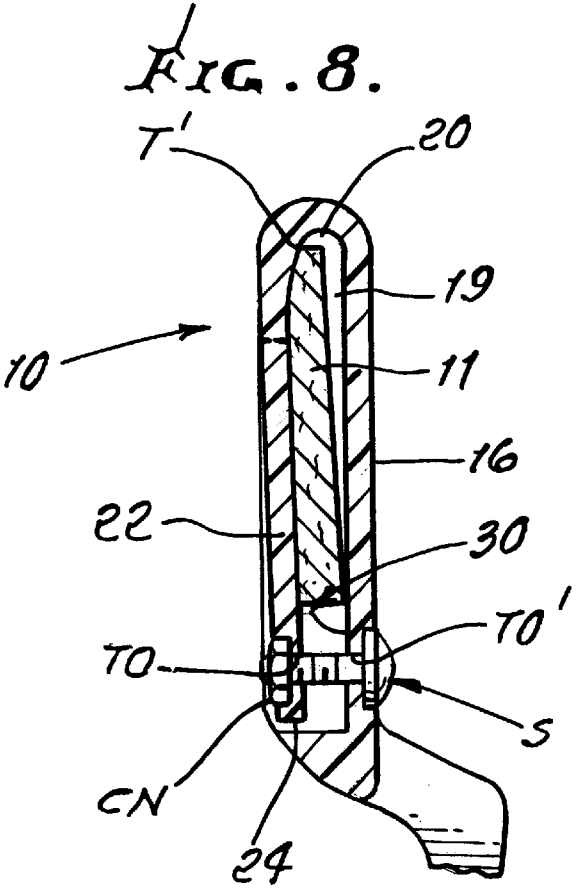
FIG. 8 is a fragmentary longitudinal sectional view of the inventive belt loop taken along lines 8—8 of FIG. 7 showing the belt loop clamped onto a belt and secured in the second taper.

Belt loop opening 19 has an upper interior end 20 and a lower interior end 21, best shown in FIGS. 4 and 8. At the lower interior end 21 of belt opening 19 is a ridge or shelf 30 best seen in FIG. 4*a*. Ridge 30 is a flat shelf, which extends the entire length of belt loop opening 19 having its widest point 31 located between fingers 22. Ridge 30 is located above opening TO' in front face 16 and opening TO in finger 22, so that the threads of a securing device, such as a screw passing through openings TO and TO' do not come into contact with duty belt 11 which rests upon shelf 30. Shelf 30 is preferably integral with the interior walls of belt opening 19 at its widest point 31. The position of ridge or shelf 30 does not interfere with the fingers' 22 ability to move about their proximal end 23.

Figure 3:
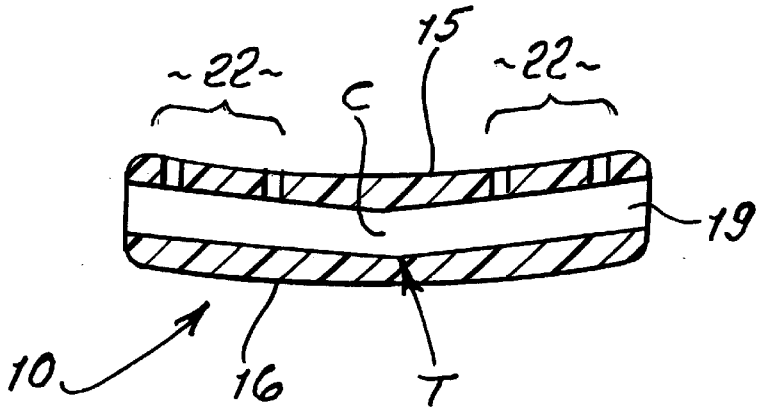
FIG. 3 is a sectional view taken along lines 3—3 of FIG. 2 showing the first taper of the belt loop.

FIG. 3 is a cross sectional view taken along lines 3—3 of FIG. 2 of clamp assembly 14 which illustrates a first taper T of belt loop opening 19. This first taper T is one of the inventive aspects of belt loop assembly 10 and aids in fixedly positioning belt loop assembly 10 along belt 11. First taper T is a narrowing of the width of belt opening 19 from its outside edges towards its center C, and acts to wedge belt 11 into the narrowed area C of belt opening 19.

FIG. 4 is a side elevational view and illustrates belt loop assembly 10 in the traditional position it would hang from belt 11. The ridge or shelf 30 can be seen clearly at the lower interior end 21 of belt opening 19. A second taper T' can also be seen at the upper interior end 20 of belt opening 19.

Figure 4A:
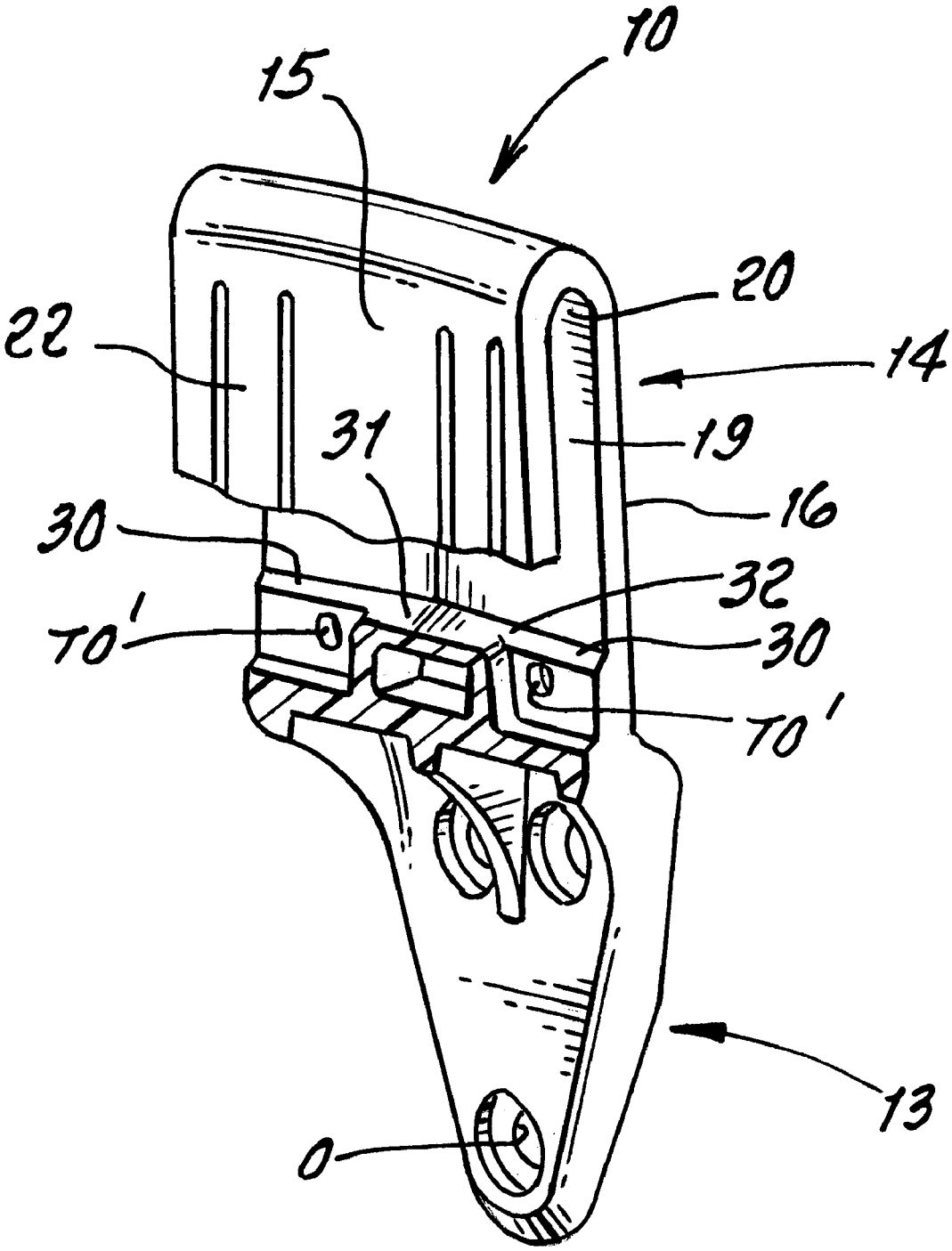
FIG. 4*a* is a front perspective view partially broken away of the inventive ridge or shelf.

FIG. 4*a* is a front perspective view partially broken away illustrating the location of shelf or ridge 30. The widest portion 31 of shelf or ridge 30 is located between fingers 22. In the preferred embodiment, the widest portion 31 of the ridge or shelf 30 is integral with the interior walls of belt loop opening 19. Shelf or ridge 30 narrows 32 as it extends away from its widest portion 31 and towards each side of the clamp assembly 14. FIG. 4*a* also illustrates fingers 22 positioned on either side of the widest portion 31 of shelf or ridge 30, such that shelf 30 cannot interfere with the movement of fingers 22 about their proximal end 23. FIG. 4*a* also illustrates shelf 30 located above openings TO', and thus is above any securing device, such as belt screws S, so that belt 11 is unlikely to be damaged.

FIG. 5 illustrates front face 16 of belt loop assembly 10. The location of ridge or shelf 30 and fingers 22 are shown by a dashed line. FIG. 5 clearly illustrates shelf 30 above openings TO'.

Figure 6:
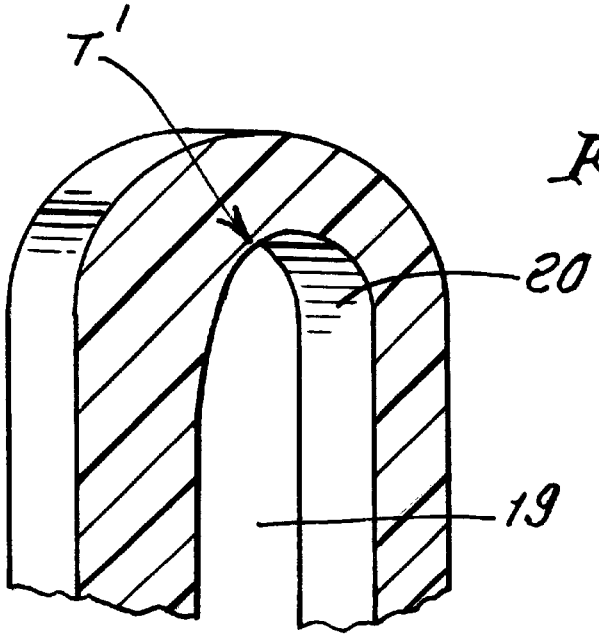
FIG. 6 is a fragmentary sectional view of the upper interior end of the belt loop opening showing the second taper.

FIG. 6 is a fragmentary sectional view of the upper interior end 20 of the belt loop opening 19, which illustrates a second taper T', which is a narrowing of the width of one side of the upper interior end 20 of belt loop opening 19. Second taper T' acts to wedge the top of belt 11 into belt opening 19. The weight of the holster and weapon also aids in wedging belt 11 into taper T'. The first taper T and the second taper T' of belt loop opening 19, as well as clamp down fingers 22 provide three separate points where belt loop assembly 10 is fixed into position along belt 11.

Figure 7:
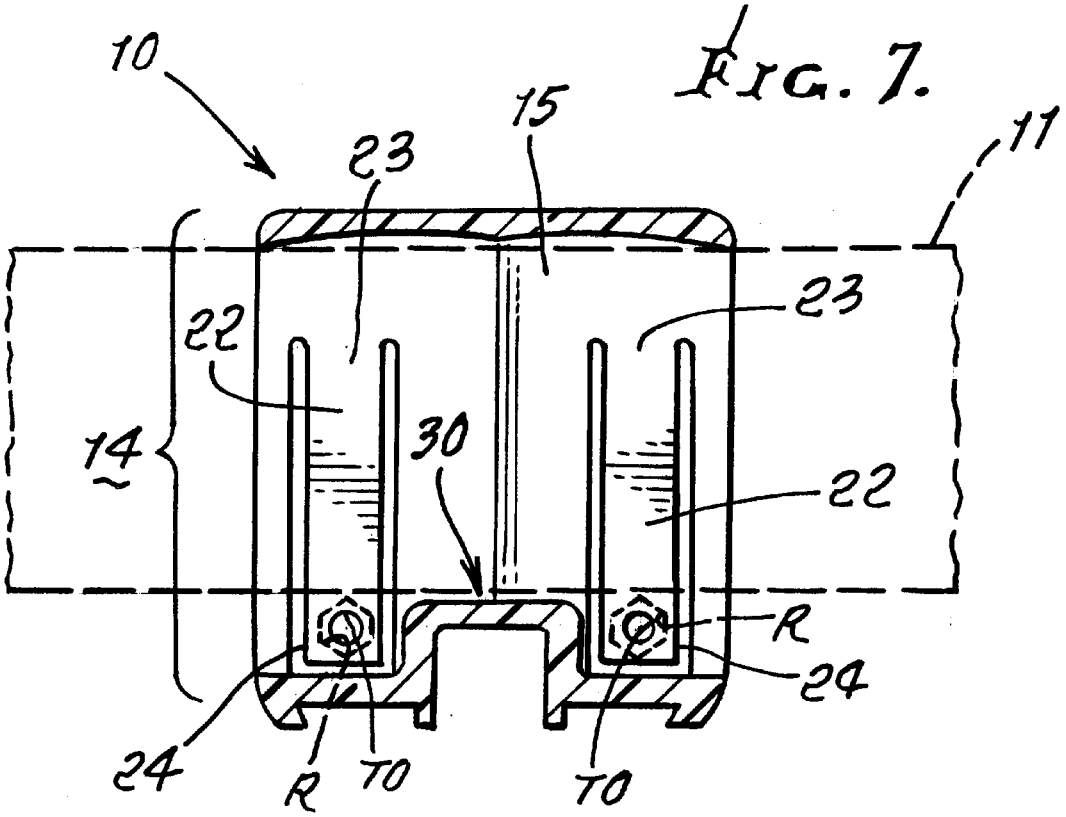
FIG. 7 is a fragmentary sectional view of the inventive belt loop taken along lines 7—7 of FIG. 4 showing the location of the ridge or shelf with a fragmentary portion of the belt also shown in phantom.

FIG. 7 is a partial sectional view taken along line 7—7 of FIG. 4 of the belt loop assembly 10 which illustrates belt 11 (shown in partial segment) resting upon shelf 30. The portion of ridge 30, upon which belt 11 directly rests, is shown above the openings TO in distal ends 24 of tongues 22, and thus out of contact with a securing means, such as belt screws.

FIG. 8 is a fragmentary sectional view of the belt loop assembly 10 taken along line 8—8 of FIG. 7 and illustrates belt loop assembly 10 fixed along belt 11. To fix the position of belt loop assembly 10 along belt 11 in the preferred embodiment, belt screws S are inserted into openings TO' of face 16 and pass through the corresponding openings TO in distal end 24 of fingers 22 and are tightened against mating nuts CN. As belt screws S are tightened against their mating nut CN, a force is exerted upon distal end 24 of finger 22 and distal end 24 is pulled inward towards face 16 causing fingers 22 to exert a compressive force against belt 11, thereby fixing or clamping the belt loop assembly 10 to belt 11. Because belt 11 rests upon ridge or shelf 30, and above belt screws S, belt 11 does not come into contact with belt screws S and is not therefore damaged by belt screws S. FIG. 8 also illustrates belt 11 wedged into second taper T' at the upper interior end 20 of belt opening 19.

Figure 9:
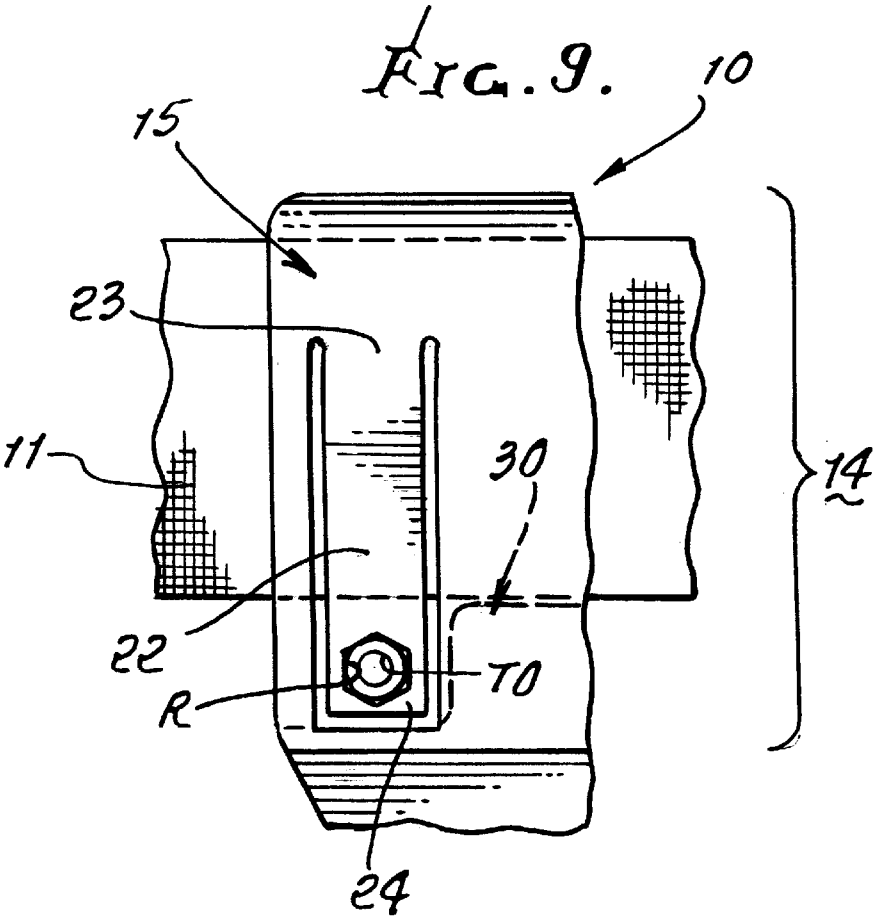
FIG. 9 is a fragmentary rear view of the belt loop of this invention with a fragmentary portion of the belt shown, in phantom.

FIG. 9 is a partial rear view of belt loop assembly 10 and illustrates the inventive belt assembly loop 10 rigidly attached to belt 11, showing one finger 22 of clamp assembly 14 after belt screws S have been tightened against mating nut CN. Belt 11 is shown resting along ridge or shelf 30 in phantom and above and away from belt screws S.

Altogether this invention provides an effective molded belt loop assembly, which, when attached to a holster, provides for the easy insertion of a duty belt and the ability to securely hold the holster in place at a selected position along the belt.

The above-described embodiments of the present invention are merely descriptive of its principles and are not to be considered limiting. The scope of the present invention instead shall be determined from the scope of the following claims including their equivalents.

We claim:

1. A belt loop assembly for hanging items from a belt comprising:

a body having a first end belt clamp section and a second end goods attachment section;

said goods attachment section having a means for securing goods to said belt loop assembly;

said belt clamp section in the general shape of an elongated oval having a top, a bottom, a first side wall, and a second side wall defining a belt-receiving slot therethrough, said slot having a height approximately the width of the belt on which it is worn and a width slightly greater than the thickness of said belt;

said belt clamp section having means for fixedly positioning said assembly along said belt; and said belt clamp section having a shelf extending outward from the interior of at least one of said side walls far enough for said belt to rest upon it, such that said belt is not damaged by said means for fixedly positioning said assembly along said belt.

2. A belt loop assembly as recited in claim 1 wherein the interior portion of said elongated oval belt-receiving slot is tapered in width from wide to narrow between the ends of said belt-receiving slot at at least in one location so as to cause said belt to fit snugly therein.

3. A belt loop assembly as recited in claim 2 wherein said taper occurs on at least one of said side walls where said side wall tapers in width from the edges of said side wall to the center of said side wall.

4. A belt loop assembly as recited in claim 2 wherein the interior portion of the top of said elongated oval is tapered.

5. A belt loop assembly as recited in claim 1 wherein said goods attachment section is set off from said belt clamp section.

6. A belt loop assembly as recited in claim 1 wherein said belt clamp section is contoured to conform to the waist region of a wearer.

7. A belt loop assembly as recited in claim 1 wherein said second side wall having at least one finger with a proximal end and a distal end where said distal end is disconnected from said second side wall so as to allow said finger to flex about its proximal end; and said belt clamp section having a means whereby said finger's proximal end can be moved toward said first side wall and against said belt and fixed in place therein so as to fixedly position said assembly along said belt.

8. A belt loop assembly as recited in claim 1 wherein said assembly is a unitary body made of a semi-rigid plastic.

9. A belt loop assembly for hanging items from a belt comprising:

a body having a first end belt clamp section and a second end goods attachment section;

said goods attachment section having a means for securing goods to said belt loop assembly;

said belt clamp section in the general shape of an elongated oval having a top, a bottom, a first side wall, and a second side wall defining a belt-receiving slot therethrough, said slot having a height approximately the width of the belt on which it is worn and a width slightly greater than the thickness of said belt;

said second side wall having at least one finger with a proximal end, and a distal end, where said distal end is disconnected from said second side wall so as to allow said finger to flex about its proximal end;

said belt clamp section having a means whereby said finger's proximal end can be moved toward said first side wall and against said belt and fixed in place therein so as to fixedly position said assembly along said belt;

said belt clamp section having a shelf extending outward from the interior of at least one of said side walls for said belt to rest upon it, said shelf's widest section positioned not to interfere with the movement of said finger; and said shelf is positioned so as to keep said belt from being damaged by said means for fixedly positioning said finger along said belt.

10. A belt loop assembly as recited in claim 9 wherein the interior portion of said elongated oval belt-receiving slot is tapered in width from wide to narrow between the ends of said belt-receiving slot at at least in one location so as to cause said belt to fit snugly therein.

11. A belt loop assembly as recited in claim 10 wherein said taper occurs on at at least one of said side walls where said side wall tapers in width from the edges of said side wall to the center of said side wall.

12. A belt loop assembly as recited in claim 10 wherein the interior portion of the top of said elongated oval is tapered.

13. A belt loop assembly as recited in claim 9 wherein said goods attachment section is offset outward from said belt clamp section when worn on a belt.

14. A belt loop assembly as recited in claim 9 wherein said belt clamp section is contoured to conform to the waist region of a wearer.

15. A belt loop assembly as recited in claim 9 wherein said assembly is a unitary body made of a semi-rigid plastic.

16. A belt loop assembly for hanging items from a belt comprising:

a body contoured to conform to the waist of the wearer having a first end belt clamp section and a second end goods attachment section;

said goods attachment section having a means for securing goods to said belt loop assembly;

said belt clamp section in the general shape of an elongated oval having a top, a bottom, a first side wall, and a second side wall defining a belt-receiving slot therethrough, said belt having a height approximately the width of the belt on which it is worn and a width slightly greater than the thickness of said belt;

said second side wall having two generally elongated fingers lying generally along said second side wall, each with a proximal end and a distal end where said distal end is disconnected from said second side wall so as to allow said fingers to flex about their proximal end;

said belt clamp section having a means whereby said fingers proximal end can be moved toward said first side wall and against said belt and fixed in place therein so as to fixedly position said assembly along said belt;

said belt clamp section having a shelf extending outward from the interior of at least one of said side walls said shelf's widest section located between said fingers;

said shelf is positioned so as to keep said belt from being damaged by said means for fixedly positioning said fingers along said belt;

the interior of said first and second side walls is tapered in width from wide to narrow from the edges of said side walls to the center of said side walls; and the interior of said top of said elongated oval belt-receiving slot is tapered in width from wide to narrow at the point where the two side walls come together to form said top.

17. A belt loop assembly as recited in claim 16 wherein said assembly is a unitary body made of a semi-rigid plastic.

* * * * *